US005169598A

United States Patent [19]

Zetlmeisl et al.

[11] Patent Number: 5,169,598

[45] Date of Patent: Dec. 8, 1992

[54] CORROSION INHIBITION IN HIGHLY ACIDIC ENVIRONMENTS

[75] Inventors: Michael J. Zetlmeisl, St. Louis; Eddie C. French, Manchester, both of Mo.

[73] Assignee: Petrolite Corporation, St. Louis, Mo.

[21] Appl. No.: 706,623

[22] Filed: May 29, 1991

[51] Int. Cl.[5] ..... C23F 11/04

[52] U.S. Cl. ..... 422/16; 422/12; 252/146; 252/148; 252/149; 564/192; 564/162; 564/4; 568/448; 548/300.1

[58] Field of Search ..... 422/12, 16; 252/146, 252/148, 149; 564/192, 162, 4; 568/448; 548/300

[56] References Cited

U.S. PATENT DOCUMENTS

| | | | |
|---|---|---|---|
| 2,049,517 | 8/1936 | Saukatis | 252/146 |
| 2,606,873 | 8/1952 | Cardwell et al. | 252/148 |
| 2,965,577 | 12/1960 | Heimann et al. | 422/12 |
| 3,453,203 | 7/1969 | Foroulis | 252/146 |
| 3,669,613 | 6/1972 | Knox et al. | 422/12 |
| 4,310,435 | 1/1982 | Frenier | 252/148 |
| 4,332,967 | 6/1982 | Thompson et al. | 564/162 |
| 4,393,026 | 7/1983 | Thompson et al. | 422/12 |
| 4,450,137 | 5/1984 | Thomson et al. | 252/149 |

*Primary Examiner*—Robert J. Warden
*Assistant Examiner*—Laura E. Collins
*Attorney, Agent, or Firm*—Kenneth Solomon

[57] ABSTRACT

A method for inhibiting corrosion of ferrous surfaces in an acidic, aqueous medium having a temperature of at least about 200° F. is disclosed. The method comprises incorporating into the mediumn a corrosion inhibiting amount of a corrosion inhibitor comprising the reaction product of an aldehyde and a composition corresponding to the formula:

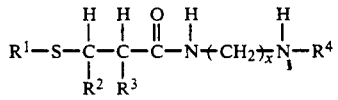

wherein $R^1$ is a hydrocarbon group, $R^2$ and $R^3$ are independently selected from H and alkyl, $R^4$ is H, alkyl, alkanol or (alkylene-N)$_n$H wherein n is at least one, and x is 2 or 3. The present invention is also directed to a such method in which the corrosion inhibitor comprises a compound corresponding to the formula:

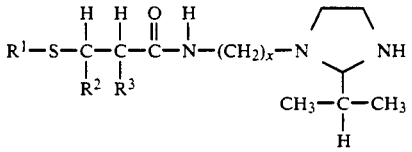

wherein $R^1$, $R^2$, and $R^3$ and x are defined as above.

18 Claims, No Drawings

CORROSION INHIBITION IN HIGHLY ACIDIC ENVIRONMENTS

BACKGROUND OF THE INVENTION

1. Field of the Invention

The present invention relates to corrosion inhibition in acidic, aqueous media, and more particularly to inhibition of corrosion of ferrous surfaces in refinery overhead streams and distillation towers.

2. Description of the Prior Art

A solution has long been sought to the common and troublesome problem of corrosion of ferrous surfaces in oil refinery overhead streams (in particular, of the crude distillation unit and vacuum distillation tower) and other distillation towers. In particular, it has been difficult to solve the problem because such streams are highly acidic, typically having a pH of from less than 1 to about 3, and are maintained at temperatures exceeding about 200° F. (93° C.). By contrast, conventional corrosion inhibitors generally are employed in environments that are characterized by far less severe conditions. For example, corrosion inhibitors employed in oil field pipelines generally are not considered satisfactory corrosion inhibitors for refinery overhead streams and distillation towers, first because the disparate nature of the oil field pipeline and refinery/distillation arts results in a failure to consider application of corrosion inhibitors from one art to another art, but also because oil field pipelines ordinarily are not strongly acidic (rarely, if ever, having a pH below about 4) and are at generally ambient temperatures. Thus, oil field corrosion inhibitors are not recognized as effective in highly acidic, high temperature conditions, which conditions themselves increase corrosion rates dramatically.

Accordingly, whereas the refinery and distillation streams include the strong acid, HCl, with which the corrosion therein is associated, and are maintained at a temperature of at least about 200° F. (93° C.), and more commonly as high as 300° F. (149° C.) or more, oil field pipeline corrosion is associated with weak acids due to the presence of hydrogen sulfide and carbon dioxide and typical pipeline temperatures are under 100° F. (38° C.).

Because corrosion inhibitors have not been found to be satisfactory under the low pH, high temperature conditions of refinery overhead streams and distillation towers, it has been common practice to attempt to resolve at least the acidity problem by neutralizing the stream by addition of ammonia or certain organic amines, such as ethylene diamine, to raise the pH above 4 (generally to about 6) before addition of the corrosion inhibitor. This technique has been found to be unsatisfactory not only because of the extra treatment step and extra additive required, but also because the amines added to the stream tend to form corrosive HCl salts, which tend to exacerbate the problem and to corrode. Yet, commercial processes which do not incorporate ammonia or an organic amine are virtually unknown. Thus, efforts to find suitable corrosion inhibitors for such applications typically have not produced entirely satisfactory results.

Accordingly, while U.S. Pat. Nos. 4,332,967 and 4,393,026, both to Thompson et al., mention that the particular compounds disclosed therein might be applicable to refineries or distillation towers, corrosion inhibitors for oil field pipelines are not recognized to be applicable generally to refinery overhead streams, especially without first neutralizing the HCl in such streams. Thompson et al. also mentions (at col. 20, lines 29–33 of '967 and col. 20, lines 4–8 of '026) that the corrosion inhibitors described therein are effective in systems of "high temperature, high pressure and high acidity, particularly in deep wells, and most particularly in deep gas wells." However, the acidity of such wells is recognized not to be below about pH 3.5, generally not below pH 4.

Thus, Thompson et al. do not suggest that the compositions described therein would be effective at lower pH's (as found in refinery overheads), or that their use in refineries would be in a manner other than the standard, conventional technique, which calls for addition of ammonia or amine to increase the pH above 4 (with the problems connected therewith). And more generally, conventional corrosion inhibitors have been found to be either ineffective or susceptible to entering into undesirable side reactions in the highly acidic conditions of refinery overheads. Moreover, while combinations of neutralizers, filming inhibitors, and water washes with water soluble filming inhibitors have been employed in overheads, no satisfactory solution to internal tower corrosion has been found.

Thus, corrosion inhibitors that are effective in the low pH, high temperature conditions of refinery overhead streams without the need for neutralizing the HCl in such streams are needed.

SUMMARY OF THE INVENTION

Briefly, therefore, the present invention is directed to a novel method for inhibiting corrosion of ferrous surfaces in an acidic, aqueous medium having a temperature of at least about 200° F. The method comprises incorporating into the medium a corrosion inhibiting amount of a corrosion inhibitor comprising the reaction product of an aldehyde and a composition corresponding to the formula:

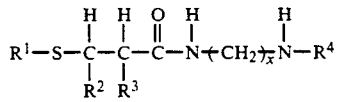

wherein $R^1$ is a hydrocarbon group, $R^2$ and $R^3$ are independently selected from H and alkyl, $R^4$ is H, alkyl, alkanol or (alkylene-N)$_n$H wherein n is at least one, and x is 2 or 3.

The present invention is also directed to a novel method for inhibiting corrosion of ferrous surfaces in an acidic, aqueous medium having a temperature of at least about 200° F., which method comprises incorporating into the medium a corrosion inhibiting amount of a corrosion inhibitor comprising a compound corresponding to the formula:

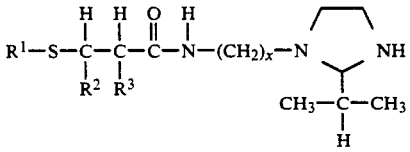

wherein $R^1$ is a hydrocarbon group, $R^2$ and $R^3$ are independently selected from H and alkyl, and x is 2 or 3. Among the several advantages found to be achieved by the present invention, therefore, may be noted the provision of a method for inhibiting corrosion in highly acidic, aqueous media; and the provision of a method for inhibiting corrosion in such media without the need for first introducing neutralizing amines.

DESCRIPTION OF THE PREFERRED EMBODIMENTS

In accordance with the present invention, it has been discovered that introducing into a highly acidic, aqueous medium a composition comprising the reaction product of an aldehyde and a composition corresponding to the formula:

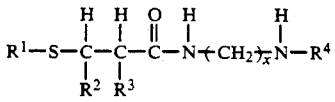

(I)

wherein $R^1$ is a hydrocarbon group, $R^2$ and $R^3$ are independently selected from H and alkyl, $R^4$ is H, alkyl, or (alkylene-N)$_n$H wherein n is at least one, and x is 2 or 3, significantly inhibits corrosion of ferrous surfaces in the medium without the need for raising the pH or lowering the temperature of the medium. Such method is particularly suited to crude unit or vacuum tower overheads and distillation columns of oil refinery streams. Moreover, it is particularly advantageous for protection internally of the towers, where corrosion inhibition has been particularly difficult to achieve.

U.S. Pat. Nos. 4,332,967 and 4,393,026, both to Thompson, et al., describe the preparation of the composition identified above by formula (I) and corrosion inhibitive usefulness of such composition, particularly in oil field pipelines and wells. Those patents also note that the compositions disclosed therein might be applicable to refineries. It was later found that reacting the composition defined by formula (I) (wherein $R^4$ and $R^2$ are hydrogen, $R^3$ is methyl and x is 2) with isobutyraldehyde yields a product of superior effectiveness in oil field pipelines, and that product has been used as a corrosion inhibitor in such settings.

However, it has now been discovered that the product is surprisingly effective in the high acid, high temperature conditions that are typically present in refinery overhead streams and eliminates, or at least significantly reduces, the need for addition of ammonia or organic amine to raise the pH of the system, and the serious drawbacks related to such neutralization techniques. This discovery is particularly surprising in view of the highly corrosive and reactive characteristics of such conditions and the fact that the search for appropriate corrosion inhibitors for such environments has been so unproductive that the industry has resorted to the problem-laden technique of employing ammonia or organic amines as neutralizing agents.

Generally, to prepare the corrosion inhibitors of this invention, a composition as described in the noted U.S. patents of Thompson et al. is reacted with an aldehyde. Preferred compositions of Thompson et al. correspond to the formula (I), above, wherein $R^1$ is a hydrocarbon group, $R^2$ and $R^3$ are independently selected from H and alkyl, $R^4$ is H, alkyl, alkanol or (alkylene-N)$_n$H wherein n is at least one, and x is 2 or 3. Because the reactions and activities desired for this composition are localized away from $R^1$, $R^1$ may be any of a wide range of hydrocarbons. However, in order to provide sufficient oil solubility without sacrificing the corrosion inhibitive properties of the composition too significantly, alkyl groups of from about 6–18 carbon atoms, such as a dodecyl group, are preferred for $R^1$. Preferably, $R^4$ is hydrogen. In addition it is also preferred that $R^2$ also be hydrogen and $R^3$ be methyl. Most preferably, x is 2. Thus, a preferred composition may be prepared by reacting equimolar amounts of n-dodecyl mercaptan, methyl methacrylate and diethylenetriamine. Techniques for preparation thereof are disclosed in the Thompson et al. patents.

The composition defined by formula (I) may be reacted with any aldehyde, although a branched aldehyde is preferred. Most preferably, the aldehyde is isobutyraldehyde.

The composition of Thompson et al. and the aldehyde are mixed in approximately equimolar proportions (+/− about 20%) and the exothermic reaction is allowed to proceed to completion. When $R^4$ is $—CH_2CH_2N—H$ and the aldehyde is isobutyraldehyde, the resulting product, therefore, contains composition of the formula:

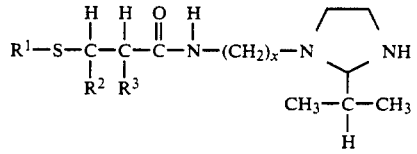

wherein $R^1$ is a hydrocarbon group, $R^2$ and $R^3$ are independently selected from H and alkyl, and x is 2 or 3. Preferred $R^1$, $R^2$, and $R^3$ substitutes are as set forth above with respect to the reactant and x is preferably 2. The product also comprises unreacted composition of Thompson et al. and unreacted aldehyde.

It has been found that the additive of this invention is particularly effective in aqueous, acidic media. It is especially applicable to such media having a pH less than 6. Moreover, in view of the unsatisfactory results of previous corrosion inhibitors in highly acidic media, the benefits of the additive particularly notable for media having a pH under 5, and even more notable for media having a pH less than 4, especially less than 3, at which pH prior art compositions are understood to be unsuitable. Likewise, the additives of this invention have been found effective even for media having a temperature in excess of about 200° F. (93° C.). Thus, the inhibitor may be employed directly into a refinery overhead or distillation tower without first raising the pH of the stream, or at least without neutralizing the stream to the extent necessitated by conventional processes.

The product may be incorporated into the medium by any standard technique. For example, where the medium is in an overhead refinery unit, the product may be injected with an appropriate carrier into the water stream of the overhead of the distillation unit or by dilution of the inhibitor in a side stream of naphtha, and injection into an overhead vapor line at a location that is above the dew point of water. For example, a typical formulation might comprise (by weight), 10% reaction product, and the remainder (optionally) methanol and Solvent 14 (a heavy aromatic solvent), although any solvent which provides a stable storage formulation would be suitable. From about 25 to about 500 ppm (preferably about 50 ppm) by weight of the formulation (i.e., about 2.5 to about 50 ppm of active components) based on the water phase has been found to be effective. If desired, neutralizer may be added, although an amount far less than required by prior art techniques would be suitable.

Preferably, the product is injected to the refinery overhead hydrocarbon condensate ahead of the formation of aqueous condensate. It has been found that the product is very oil soluble in neutral form, but when it becomes protonated by contact with the acidic water, it becomes very water soluble and, therefore, partitions to the water phase, thereby to provide corrosion inhibition to the water phase where corrosion is a problem.

The following examples describe preferred embodiments of the invention. Other embodiments within the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the examples. In the examples all percentages are given on a weight basis unless otherwise indicated.

EXAMPLE 1

In the refinery overhead the composition of liquids in general is about 1–10% water, typically about 5% water and 90–99% hydrocarbon, typically about 95% hydrocarbon with varying amounts of chlorides, some sulfates and dissolved $H_2S$ at low pH. Under these conditions, corrosion occurs in the aqueous phase. Because of the infeasibility of laboratory electrochemical measurement of corrosion rates in a 5% water and 95% hydrocarbon mixture, it was therefore decided to use 2 parts water and 1 part hydrocarbon. If anything this composition makes the system more corrosive, thus an inhibitor that is capable of controlling corrosion under these conditions should prove more effective under the field conditions. For these corrosion measurements, kettles filled with 600 ml of 0.1M $Na_2SO_4$ (employed as an inert supporting electrolyte to permit electrochemical measurements to be made in the tests) and 300 ml of Isopar-M (a trade designation for a distilled hydrocarbon obtained from Exxon) were used. The pH of the solution was adjusted to 3 with about 1% HCl and then maintained at 3 using 0.1M HCl with the help of the pH controllers. Therefore, the chloride concentration was about 35 ppm. The mixture was sparged with 1% $H_2S$ in argon for an hour at 160° F. (71° C.) and a stirring rate of about 400 rpm. Then carbon steel PAIR ® electrodes were immersed in the mixture and the corrosion rate was monitored by means of linear polarization for about 22 hr under continuous 1% $H_2S$ sparge. In addition to the electrochemical measurements, integrated weight loss was determined for the duration of the test. The weight loss and electrochemical measurements were in good agreement. A few corrosion tests were also conducted using deionized water with no additional electrolyte except HCl, used for pH adjustment of the solution.

For each of a series of tests, the product produced from reacting 0.17 moles of isobutyraldehyde with the equivalent of 0.2 moles of the product of a reaction of equimolar amounts of n-dodecyl mercaptan, methyl methacrylate and diethylenetriamine, was added to kettles in an amount equivalent to 3.2 ppm based on the water phase. The product was added as a 10% mixture also comprising 10% branched alcohol and the remainder methanol and Solvent 14. Tests were conducted at various temperatures and pH's and compared to corrosion rates with no additives (blank). The results were as follows: With Additives:

| pH | Temperature (°F.) | Corrosion Rate (mpy, wt. loss) |
|---|---|---|
| 3 | 65 | 8.5 |
| 3 | 75 | 6.4 |
| 3 | 85 | 29.0 |
| 3 | 95 | 29.8 |
| 2 | 65 | 38.5 |
| 3 | 65 | 8.5 |
| 4 | 65 | 8.8 |
| 5 | 65 | 13.7 |
| Blanks (No Additives): | | |
| 2 | 65 | 3763 |
| 3 | 65 | 544 |
| 4 | 65 | 137 |
| 5 | 65 | 26.3 |

EXAMPLE 2

The inhibitor of Example 1 was tested as an inhibitor in a sidestream apparatus on a crude unit overhead at at Midwest refinery. The apparatus condensed the hydrocarbon and water vapor from the overhead line (before the heat exchangers) and sent the condensed mixture through a series of three electrochemical cells, each cell containing about 200 ml combined hydrocarbon and water. About 50 ppm of inhibitor was injected ahead of the cells. Neutralizer was not used. The pH of the water was about 5 linear polarization measurements of the corrosion rate (in mpy) yielded the following results.

| Elapsed Time (mins.) | Cell 1 | Cell 2 | Cell 3 |
|---|---|---|---|
| 0 | 110 | 90 | 120 |
| 5 | 110 | 95 | 100 |
| 15 | 110 | 160 | 40 |
| (At this point 50 ppm inhibitor was added) | | | |
| 25 | 0 | 70 | 4 |
| 40 | 0 | 15 | 0 |
| 50 | 0 | 7 | 0 |

In view of the above, it will be seen that the several advantages of the invention are achieved and other advantageous results attained.

As various changes could be made in the above methods and compositions without departing from the scope of the invention, it is intended that all matter contained in the above description shall be interpreted as illustrative and not in a limiting sense.

What is claimed:

1. A method for inhibiting corrosion of ferrous surfaces comprising incorporating into an acidic, aqueous medium having a temperature of at least about 200° F., a corrosion inhibiting amount of a corrosion inhibitor comprising a reaction product of an aldehyde and a composition corresponding to the formula:

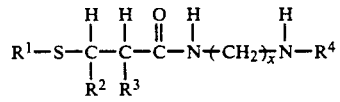

wherein $R^1$ is a hydrocarbon group, $R^2$ and $R^3$ are independently selected from H and alkyl, $R^4$ is H, alkyl, alkanol or $(\text{alkylene-N})_n\text{H}$ wherein n is at least one, and x is 2 or 3.

2. A method as set forth in claim 1, wherein the aldehyde is a branched aldehyde.

3. A method as set forth in claim 2, wherein the aldehyde is isobutyraldehyde.

4. A method as set forth in claim 1, wherein $R^4$ is H.

5. A method as set forth in claim 4, wherein $R^2$ is H and $R^3$ is methyl.

6. A method as set forth in claim 5, wherein n is 2.

7. A method as set forth in claim 4, wherein the aldehyde is a branched aldehyde.

8. A method as set forth in claim 5, wherein the aldehyde is a branched aldehyde.

9. A method as set forth in claim 6, wherein the aldehyde is a branched aldehyde.

10. A method as set forth in claim 4, wherein aldehyde is isobutyraldehyde.

11. A method as set forth in claim 5, wherein aldehyde is isobutyraldehyde.

12. A method as set forth in claim 6, wherein aldehyde is isobutyraldehyde.

13. A method as set forth in claim 1, wherein the medium has a pH of less than about 6.

14. A method as set forth in claim 13, wherein the medium has a pH of less than about 4.

15. A method as set forth in claim 1, wherein the medium is in a crude unit or vacuum tower overhead refinery stream.

16. A method as set forth in claim 1, wherein the medium is located inside a distillation column.

17. A method as set forth in claim 1, wherein the medium is located in a refinery overhead.

18. A method for inhibiting corrosion of ferrous surfaces in an acidic, aqueous medium having a temperature of at least about 200° F., comprising incorporating into an acidic, aqueous medium a corrosion inhibiting amount of a corrosion inhibitor comprising a compound corresponding to the formula:

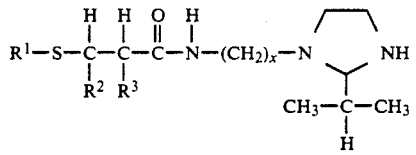

wherein $R^1$ is a hydrocarbon group, $R^2$ and $R^3$ are independently selected from H and alkyl, and x is 2 or 3.

* * * * *